US009702561B2

(12) United States Patent
Grüger et al.

(10) Patent No.: US 9,702,561 B2
(45) Date of Patent: Jul. 11, 2017

(54) MACHINE COMPONENT AND GAS TURBINE

(75) Inventors: Birgit Grüger, Dortmund (DE); Elke Henschel, Mülheim an der Ruhr (DE); Joachim Skoczowski, Leegebruch (DE); Martin Stapper, Kamp-Lintfort (DE)

(73) Assignee: SIEMENS AKTIENGESELLSCHAFT, München (DE)

( * ) Notice: Subject to any disclaimer, the term of this patent is extended or adjusted under 35 U.S.C. 154(b) by 2139 days.

(21) Appl. No.: 12/745,909

(22) PCT Filed: Oct. 31, 2008

(86) PCT No.: PCT/EP2008/064768
§ 371 (c)(1),
(2), (4) Date: Jun. 3, 2010

(87) PCT Pub. No.: WO2009/071395
PCT Pub. Date: Jun. 11, 2009

(65) Prior Publication Data

US 2010/0269510 A1 Oct. 28, 2010

(30) Foreign Application Priority Data

Dec. 4, 2007 (EP) ..... 07023418

(51) Int. Cl.
*F23M 5/02* (2006.01)
*F23R 3/00* (2006.01)
*C23C 24/10* (2006.01)

(52) U.S. Cl.
CPC ..... *F23R 3/007* (2013.01); *C23C 24/10* (2013.01); *F23M 5/02* (2013.01); *F23M 2900/05001* (2013.01); *F23M 2900/05002* (2013.01); *F23M 2900/05003* (2013.01); *F23M 2900/05004* (2013.01); *F23R 2900/03342* (2013.01)

(58) Field of Classification Search
CPC ..... F23R 3/007; C23C 24/10; F23M 5/02
USPC ..... 60/752
See application file for complete search history.

(56) References Cited

U.S. PATENT DOCUMENTS

| | | | | |
|---|---|---|---|---|
| 4,289,447 | A * | 9/1981 | Sterman et al. | 415/200 |
| 5,043,548 | A * | 8/1991 | Whitney et al. | 219/121.47 |
| 5,216,886 | A | 6/1993 | Ewing | |
| 2002/0172799 | A1* | 11/2002 | Subramanian | 428/116 |

FOREIGN PATENT DOCUMENTS

| | | |
|---|---|---|
| CN | 2625695 | 7/2004 |
| DE | 10 2004 001 722 A1 | 8/2005 |
| EP | 1283278 A2 | 2/2003 |
| EP | 1 715 249 A1 | 10/2006 |

(Continued)

*Primary Examiner* — Stephen K Cronin
*Assistant Examiner* — Jacob Amick

(57) ABSTRACT

A machine component including a base body produced from a base material is provided. The base body is equipped in a partial region of the surface thereof with a plating made of an application material having a greater hardness and/or viscosity as compared to the base material. The plating is foamed by a number of plating elements that are applied to the base body in the longitudinal direction thereof in a tilted manner relative to the main flow direction of a hot gas flowing through the base body.

19 Claims, 4 Drawing Sheets

(56) References Cited

FOREIGN PATENT DOCUMENTS

| | | | |
|---|---|---|---|
| EP | 1 865 258 | A1 | 12/2007 |
| RU | 2088764 | C1 | 8/1997 |
| RU | 2088836 | C1 | 8/1997 |
| RU | 2229031 | C2 | 5/2004 |
| WO | WO 96/04511 | A1 | 2/1996 |
| WO | WO 02081868 | A1 | 10/2002 |

* cited by examiner

MACHINE COMPONENT AND GAS TURBINE

CROSS REFERENCE TO RELATED APPLICATIONS

This application is the US National Stage of International Application No. PCT/EP2008/064768, filed Oct. 31, 2008 and claims the benefit thereof. The International Application claims the benefits of European Patent Office application No. 07023418.2 EP filed Dec. 4, 2007. All of the applications are incorporated by reference herein in their entirety.

FIELD OF INVENTION

The invention relates to a machine component having a base body produced from a base material, said base body being equipped in a partial region of its surface with a plating made of an application material with a greater hardness and/or toughness than the base material. It also relates to a gas turbine with a number of machine components of this type.

BACKGROUND OF INVENTION

Turbines, in particular gas turbines, are used in many fields to drive generators or production machines. The energy content of a fuel is used here to generate a rotational movement of a turbine shaft. To this end the fuel is combusted in a combustion chamber, during which process air compressed by an air compressor is supplied. The working medium produced in the combustion chamber by fuel combustion, which is at high pressure and has a high temperature, is guided by way of a turbine unit downstream of the combustion chamber, where it expands in a productive manner.

To generate the rotational movement of the turbine shaft a number of blades, generally combined in blade sets or rows of blades, are disposed on said turbine shaft, driving the turbine shaft by way of a pulse transfer from the working medium. Rows of vanes connected to the turbine housing are also generally disposed between adjacent rows of blades to guide the working medium in the turbine unit.

A turbine of this type comprises a plurality of elements or machine components, which are positioned appropriately in the turbine in compliance with predetermined dimensions, forms and/or tolerances. In many instances it may be desirable to minimize contact between adjacent machine components or elements, to keep wear of the relevant elements particularly low in such a manner. However during operation of the turbine it may be that actually undesirable contact between such elements occurs repeatedly due for example to thermal expansion or even to vibrations or the like produced during operation, so that a certain level of wear of such components results. Generally such machine components disposed adjacent to one another in the region of the combustion chamber of the gas turbine are for example what is known as a flame tube, a combined housing and an inner housing. Due to their structure these demonstrate such major deformation and critical tolerances that during operation of the gas turbine contact between said elements is unavoidable in places. Such contact produces undesirable and in particular possibly also critical wear over a long operating period, so said elements have to be inspected at regular intervals and be replaced/repaired as required.

In order to keep the level of wear of the relevant elements or machine components particularly low in such situations, the machine components can be produced in what is known as a plated design, whereby the regions particularly affected by the anticipated wear or contact with adjacent components are covered with a protective coating also referred to as plating. Such plating can be formed from an application material, which has a greater mechanical hardness and/or toughness than the base material of the respective component, so that wear occurring due to contact can be reduced by such an appropriate material selection. It is also possible to achieve greater corrosion resistance of the elements of the machine components by appropriate different chemical compositions of the base and/or application material.

The generally greater hardness and/or toughness of the application material for such purposes means that it is also more brittle than the respective base material of the base body of the machine component. Further processing of the base body equipped with the application material, for example by bending or the like, is therefore only possible to a limited extent.

Also cracks can form and other damage can occur in the region equipped with the application material during thermal expansion of the base body due to the different thermal expansion behavior. Machine components plated thus are therefore only conditionally suitable for use in regions with comparatively high thermal stress, for example in the interior of the combustion chamber of a gas turbine.

Since however the machine component should be equipped with appropriate plating so that it can essentially be used in compliance with wear-resistant working conditions and in order to avoid the possible disadvantages associated with plating, it is expedient to keep the lateral expansion of the plating as small as possible. In order still to be able to cover a sufficiently large partial region of the surface, individual zones of plating are embodied as decoupled from one another, in order thus to allow adequate yield in respect of thermal deformation and the like. This is achieved by embodying the plating in segments and forming it from a number of plating segments.

The plating segments can be applied to the base body of the machine component by means of appropriate techniques. However the plating segments are advantageously applied to the base body by hardfacing welding so that a particularly close connection to the base body is achieved and therefore a high level of stability of the machine component as a whole.

However for the segmented embodiment of the plating it is necessary to start and terminate the welding operation frequently, which can result in distortion of the base body due to the high working temperatures during hardfacing. Also in many instances cooling air is conducted around the outer region of the base body. The arrangement of the segments causes the cooling air to be injected into the hot gas path in the channels provided, with the result that hot and cold spots are produced corresponding to segmentation at the crossover points resulting from the segmentation preparations. Also a reduction in transverse stability and torsional rigidity of the rings forming the base body are associated with the segmentation of the plating elements in some circumstances.

SUMMARY OF INVENTION

The object of the invention is therefore to specify a machine component of the type mentioned above, the plating application of which achieves the greatest possible stability while simultaneously having further processing capability and less stress on the machine component due to the application method. Furthermore the occurrence of hot and cold spots is to be largely prevented. A gas turbine with a number of such machine components is also to be specified.

According to the invention this object is achieved in that the plating is formed by a number of plating elements, which are applied to the base body being tilted in their longitudinal direction in relation to the main flow direction of a hot gas flowing through the base body.

Advantageous embodiments of the invention are the subject matter of the subclaims.

The invention is based on the consideration that a stress due to frequent start and stop operations during hardfacing can be avoided, if the welding operation is carried out continuously. Also an appropriate arrangement of the plating elements allows a particularly high level of transverse stability to be achieved and appropriate guidance of the cooling air allows a negative effect of the cooling air on the thermal behavior of the base body to be largely avoided.

To achieve an arrangement of the plating elements running around the base body in a spiral manner and therefore a particularly high level of stability of the base body and a reduction of the start and stop points during the welding operation for the application material, one configuration of the plating elements is advantageously provided with a tilt angle of more than zero and less than 90° between the main flow direction of the hot gas flowing through the base body and the longitudinal direction of the plating elements, resulting in a parallelogram for the faint of the plating elements, although other basic geometric forms are also possible.

In one particularly advantageous embodiment the tilt angle is designed so that an arrangement results for the plating elements such that the cooling air channel formed by the oblique plating geometry runs around the base body in at least one simple embodiment and as a result the cooling air is twisted in relation to the flow direction of the hot gas, thereby allowing largely regular distribution of the cooling air to be achieved.

To achieve the greatest possible flexibility for further processing of the machine component to which the plating is applied, the plating elements applied to the base body with a tilt angle of more than zero and less than 90° between the main flow direction of the hot gas flowing through the base body and the longitudinal direction of the plating elements are advantageously not disposed on the base body continuously but segments, in other words with a number of interruptions in the hardfacing operation.

To avoid correction of the projections of the weld seams that may occur during the welding operations required to apply the plating and still to ensure compliance with tolerance limits and homogenization of the surface of the machine component, provision is advantageously made to apply the plating segments by laser powder hardfacing but application by means of other welding methods or by spray build up is also possible.

The advantages achieved with the invention in particular consist in that the arrangement of the plating segments allows a particularly high level of transverse stability and torsional rigidity of the rings forming the base body to be achieved as well as particularly advantageous guidance of the cooling air while simultaneously achieving flexibility of the base body in respect of further processing.

BRIEF DESCRIPTION OF THE DRAWINGS

An exemplary embodiment of the invention is described in more detail below based on figures, in which.

Identical parts are shown with the same reference characters in all the figures.

DETAILED DESCRIPTION OF INVENTION

Figure 1:
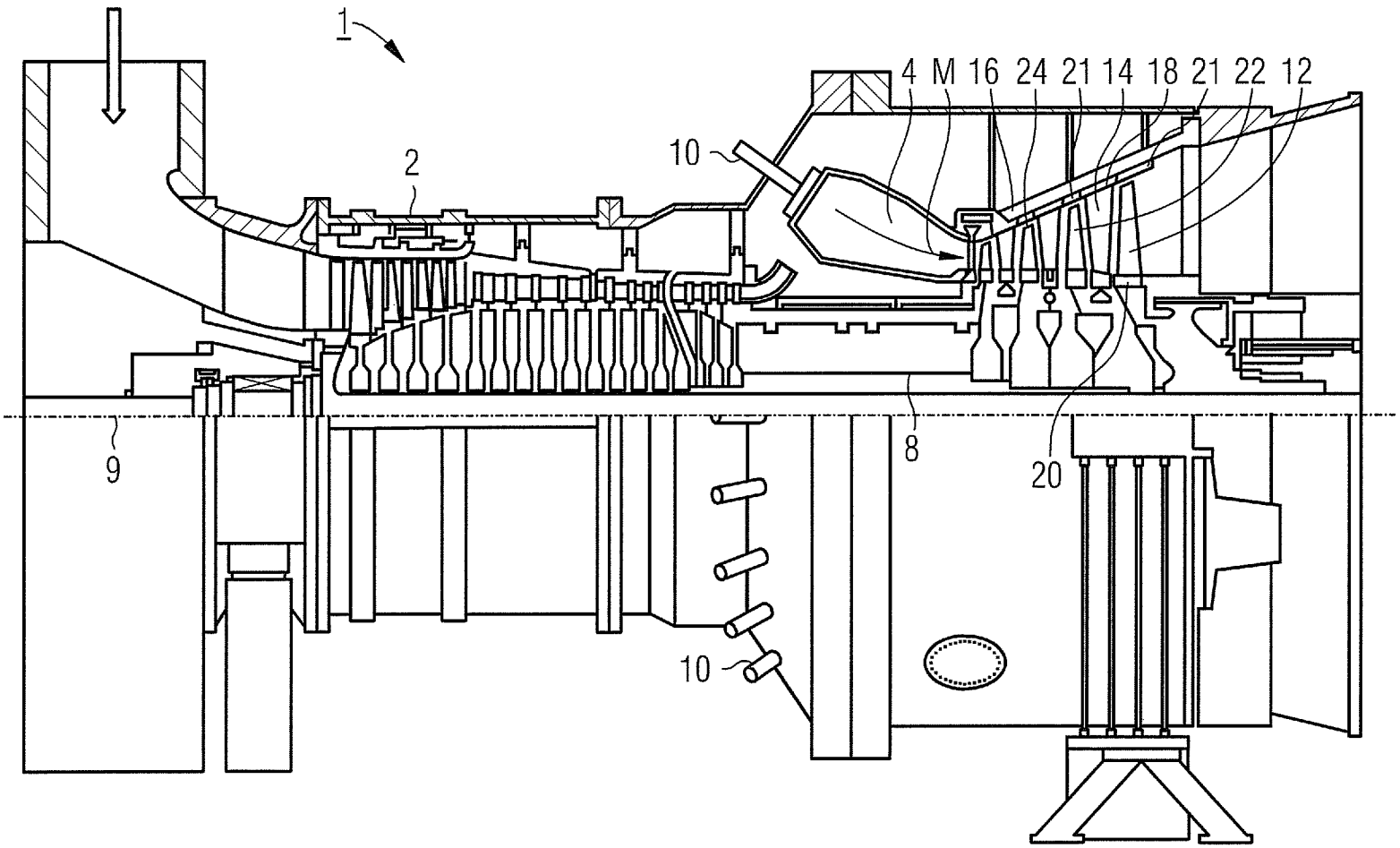
FIG. 1 shows a longitudinal section through a gas turbine.

The gas turbine 1 according to FIG. 1 has a compressor 2 for combustion air, a combustion chamber 4 and a turbine 6 to drive the compressor 2 and a generator (not shown) or a production machine. To this end the turbine 6 and compressor 2 are disposed on a common turbine shaft 8 also referred to as a turbine rotor, to which the generator or production machine is also connected and which is supported in such a manner that it can rotate about its center axis 9.

The combustion chamber 4 is equipped with a number of burners 10 to combust a liquid or gaseous fuel. It is also provided with heat shield elements (not shown in detail) on its inner wall.

The turbine 6 has a number of rotatable blades 12 connected to the turbine shaft 8. The blades 12 are disposed on the turbine shaft 8 in an overlapping ring, thereby forming a number of rows of blades. The turbine 6 also comprises a number of fixed vanes 14, which are likewise secured to an inner housing 16 of the turbine 6 in an overlapping ring, forming rows of vanes. The blades 12 here serve to drive the turbine shaft 8 by pulse transfer from a working medium M flowing through the turbine 6. The vanes 14 in contrast serve to guide the flow of the working medium M between two successive rows of blades or overlapping rings of blades respectively viewed in the flow direction of the working medium M. A successive pair consisting of an overlapping ring of vanes 14 or a row of vanes and an overlapping ring of vanes 12 or a row of blades is also referred to here as a turbine stage.

Each vane 14 has a platform 18, which is disposed as a wall element to fix the respective vane 14 to the inner housing 16 of the turbine 6. The platform 18 here is an element subject to relatively high thermal stress, which forms the outer boundary of a hot gas channel for the working medium M flowing through the turbine 6. Each blade 12 is secured to the turbine shaft 8 in a similar manner by way of a platform 20 also referred to as a blade foot.

A guide ring 21 is disposed on the inner housing 16 of the turbine 6 in each instance between the platforms 18, which are disposed at a distance from one another, of the vanes 14 of two adjacent rows of vanes. The inner surface of each guide ring 21 is also exposed to the hot working medium M flowing through the turbine 6 and is distanced by a gap 24 in the radial direction from the outer end 22 of the blades 12 of a row of blades opposite it.

This principle is applicable to all gas turbines 1, in other words for example with can, can-annular, annular combustion chambers or silo combustion chambers. In the following a gas turbine refers in particular to a gas turbine with silo combustion chambers. Nevertheless this invention is applicable to all gas turbines.

Figure 2:
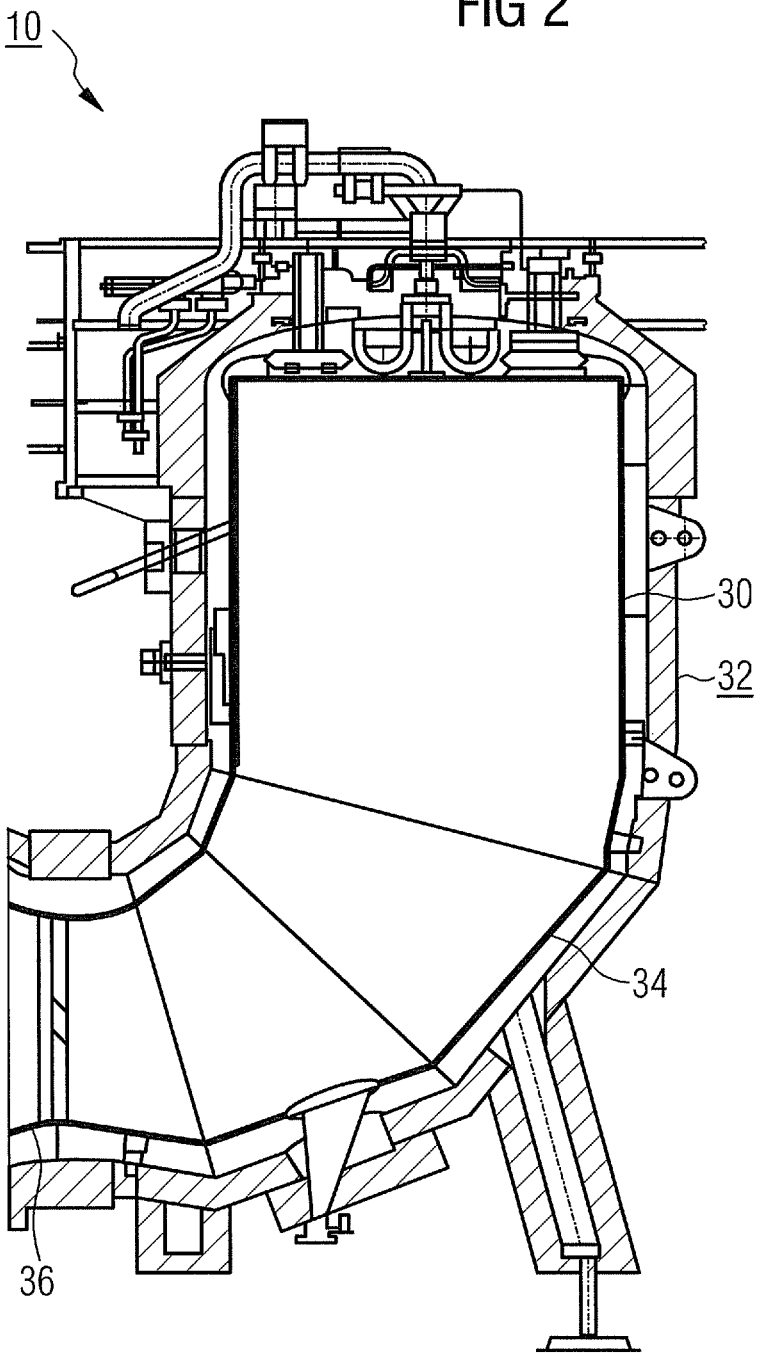
FIG. 2 shows a section through a combustion chamber in a gas turbine according to FIG. 1, FIGS. 3 to 5 respectively show machine components of the gas turbine according to FIG. 1.

As can be seen in the enlarged diagram in FIG. 2, each of the combustion chambers 4 is equipped in its inflow region, to which a number of supply lines (not specified) are connected for mediums such as fuel and combustion air, with what is known as a flame tube 30, within which combustion of the fuel takes place. The flame tube 30 is connected on the output side to an inner housing 36 of the combustion chamber 4 by way of a transition piece 34 likewise disposed within the housing 32 of the respective burner 10 and also referred to as a combined housing.

The flame tube 30, the transition piece 34 and the inner housing 36 here are connected to one another in the manner of tubes stacked inside one another, so that reliable guidance of the medium flow is ensured from the flame tube 30 into the inner housing 36 of the combustion chamber 4. The respectively stacked tube ends here are positioned where possible without contact with one another while complying with the predetermined dimensions and tolerances, so that wear due to components coming into contact with one another and rubbing against one another is avoided where possible. However for operational reasons constantly recurring contact between these components cannot be avoided during operation of the gas turbine 1, so that residual wear has to be taken into account in each instance. To take account of such wear a regular check is required in the context of maintenance and inspection work and in some instances the replacement of such components.

To keep the operational outlay of the gas turbine 1 particularly low and to simplify the necessary inspection and maintenance work to a large degree, the components of the gas turbine 1 are designed to be as wear-resistant as possible. To take account of the wear caused by contact between such machine components as the flame tube 30, transition piece 34 and inner housing 36 and to keep such wear particularly minor when contact occurs between the components, said machine components are embodied as plated components. To this end each of the machine components such as the flame tube 30, transition piece 34 and inner housing 36 is made from a base body 40 produced from a base material, which is equipped in a partial region of its surface shown respectively in FIGS. 3 to 5 with a plating 42 made of an application material. The application material here is selected so that it has a greater hardness and/or toughness than the base material, so there is a greater resistance to mechanical and also thermal stress. The application material here is applied to the base body 40 by hardfacing in each instance.

To avoid any detrimental effects on the production, assembly and operation of the respective machine components due to the plating 42, as could occur for example due to the different thermal expansion behavior and associated crack formation during the actual welding operation or even during operation at increased thermal stress, the plating 42 of the respective machine component is embodied in a segmented manner. To this end the plating 42 comprises a plurality of plating segments 44, the dimensioning of the plating segments 44 in respect of the dimensioning of the actual machine component and the materials used being selected so that too great a detrimental effect on the base body 44 due to different thermal expansion behavior and the like is avoided.

Figure 3:
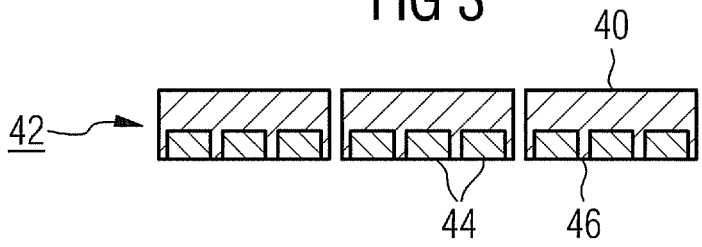
Figure 4:
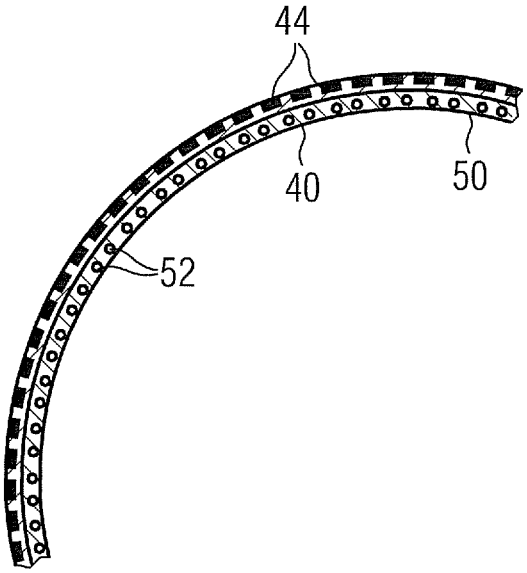
Figure 5:
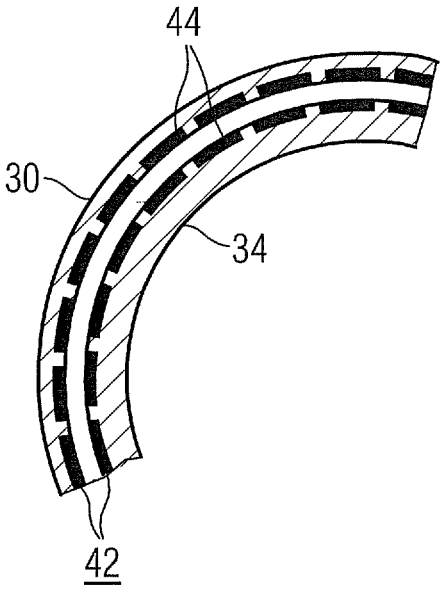

As can be seen in the diagram in FIG. 3, the plating segments 44 are introduced respectively into assigned recesses in the base body 40. The recesses here can be introduced by means of appropriate machining methods, such as by milling, turning or grinding for example. Dimensioning here can essentially be undertaken so that the plating segments 44 are applied to a flat surface of the base body 40 and corresponding recesses corresponding to their thickness therefore result between them. When positioning the plating segments 44, production can however also take place as shown in FIGS. 3 to 5 such that the outer surface of the plating segments 44 form a continuous and therefore flat surface with the outer surfaces of the studs 46 of the base body 40 running between the outer plating segments 44. The plating segments 44 can also be applied to a flat, unrecessed area.

The resulting finished machine component is therefore an element which corresponds as far as possible in form, dimensioning and dimensional accuracy to an originally provided element and in particular has a correspondingly smooth and planar surface.

FIG. 4 shows that a curved cooling air ring 50 can also be embodied as an at least partially plated machine component of the abovementioned type. The cooling air ring 50 is likewise equipped here on its surface with plating segments 44, which are incorporated into corresponding recesses of the base body 40 forming the cooling air ring 50. More cooling air channels 52 are also provided in the base body 40 of the cooling air ring 50, being formed by corresponding drilled holes. The form of the recesses, also referred to as pockets, in which the plating segments 44 are disposed here, said recesses not having to be formed in the manner of pockets, rather a peripheral groove (not shown) is also possible here, means that the desired geometry of the cooling air ring 50 can be retained. Nevertheless an almost smooth surface that is therefore favorable to the flow and a flat transition to the base body 40 are still achieved even when the plating segments 44 are used. This ensures greater wear reduction and better binding between the materials used.

FIG. 5 shows that in particular the transition piece 34 and the flame tube 30 of the gas turbine 1 are embodied in their overlapping region as such plated machine components. Plating 42 of such machine components is provided on the facing surface segments in each instance here. With such an adjacent arrangement of two such plated machine components it is also possible, as provided for in the present instance for the transition piece 34 and the flame tube 30, to focus the wear on one of the two machine components, in particular on the machine component that is easier to replace, by means of appropriate selection of the material for the plating 42. To this end provision is specifically made in the present instance to select the application material for the plating 42 of the flame tube 30 with a lesser hardness and/or toughness than the material for the plating 42 of the transition piece 34. But a converse arrangement, providing an application material for the plating 42 of the transition piece 34 with lesser hardness and/or toughness than for the plating 42 of the flame tube 30 can also prove expedient.

Figure 6:
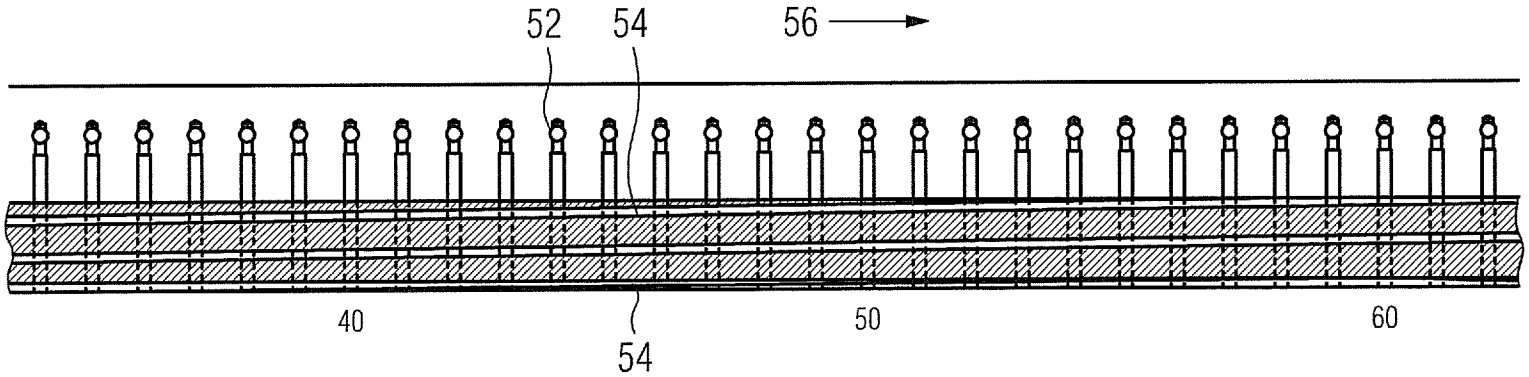
FIG. 6 shows a graphic illustration of a base body of a machine component with plating elements.

FIG. 6 shows the base body 40 with the cooling air channels 52 and the positioned plating elements 54, with the angle between the main flow direction 56 of the hot gas flowing along the walls of the base body 40 and the longitudinal direction of the plating elements 54 being selected to be particularly small in this embodiment. The plating elements 54 enclose the base body 40 in such an embodiment in the form of a helix, the tilt angle being selected in a range greater than 0 and smaller than 90° as required.

As a result the plating elements 54, which are advantageously applied to the base body 40 by laser powder hardfacing, can be applied in a continuous welding operation without start/stop operation and the risks associated with the respective termination and resumption of the welding operation, particularly the susceptibility to error during the welding process, are reduced. Also the detrimental thermal effects and therefore material stress on the base body 40 and the application material can largely be avoided by a continuous welding operation.

Segmentation of the plating 42 by interrupting the welding operations of hardfacing is also possible in this embodiment. This allows greater flexibility of the machine component to be achieved.

Figure 7:
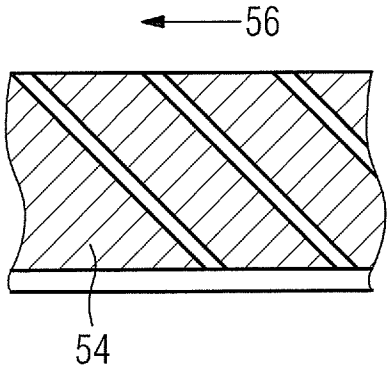
FIG. 7 shows a schematic illustration of an arrangement of plating segments.

In contrast FIG. 7 shows the plating elements 54 applied to the base body 40 at a larger angle compared with the view in FIG. 6 between the main flow direction 56 of the gas and the longitudinal direction of the plating elements 54. This is comparable in form to the threads of a screw or a threaded rod, the pitch of the embodiment of the plating 42 formed by the plating elements 54 and comparable to a thread of the abovementioned type being determined by the tilt angle. If the tilt angle is correspondingly small, the alignment of the plating elements 54 produces only one path, in other words one circumference of the plating elements 54 formed by hardfacing around the base body and therefore also only one channel to guide the cooling air for example.

The larger the tilt angle, which is provided as 45° in FIG. 7, the more circumferences of the plating elements 54 around the base body 40 result. The positioning shown means that the plating elements 54 run around the base body 40 a number of times, thereby producing segmentation of the plating elements 54, in other words division of the plating into the plating segments 44, and the plating segments 44 have to be applied in a number of welding operations.

The individual plating segments 44 are used for transverse reinforcement of the base body 40, it still being possible to carry out subsequent further processing of the base body 40 equipped with the application material, for example bending or the like, due to the segmentation of the plating elements 54.

The tilt angle between the main flow direction 56 of the gas and the longitudinal direction of the plating elements 54 produces channels, whereby in the case of cooling air flowing into the channels, such cooling air is twisted in relation to the flow direction 56 of the hot gas flowing through the base body 40 and the cooling air is therefore distributed more regularly than for example when the plating is segmented in rectangular form on the periphery of the base body 40. This allows temperature and tension differences corresponding to the design of the channels and an excessive formation of hot and cold spots subjecting the machine components to stress to be reduced.

The invention claimed is:

1. A machine component, comprising:

a base body, comprising:

a base material;

wherein the base body is equipped in a partial region of a surface with a plating, wherein the plating is made of an application material with a greater hardness and/or toughness than the base material, and wherein the plating is formed by a plurality of plating elements, the plurality of plating elements are applied to the base body tilted in their longitudinal direction in relation to a main flow direction of a hot gas flowing through the base body, and wherein the plating elements are arranged about the base body in a spiral manner thereby allowing an application of the plating elements to the base material such that stress on the material is reduced.

2. The machine component as claimed in claim 1, wherein a tilt angle is greater than 0° and less than 90°.

3. The machine component as claimed in claim 1, wherein the plurality of plating elements are positioned in a segmented configuration.

4. The machine component as claimed in claim 1, wherein the plating elements are applied to the base body by welding.

5. The machine component as claimed in claim 4, wherein the plating elements are applied to the base body by laser powder hardfacing.

6. The machine component as claimed in claim 1, wherein the plating elements are applied to the base body by a spray build up.

7. The machine component as claimed in claim 3, wherein the plating elements are introduced to a flat surface of the base body.

8. The machine component as claimed in claim 1, wherein each plating element is incorporated into an assigned recess formed in the base body.

9. The machine component as claimed in claim 1, wherein the machine component is a curve cooling air ring equipped on the surface with the plurality of plating elements incorporated into a plurality of recesses in the base body, and wherein a plurality of cooling air channels are disposed in the base body.

10. A gas turbine, comprising:

a plurality of machine components, each comprising:

a base body, comprising:

a base material, wherein the base body is equipped in a partial region of a surface with a plating, wherein the plating is made of an application material with a greater hardness and/or toughness than the base material, and wherein the plating is formed by a plurality of plating elements, the plurality of plating elements are applied to the base body tilted in their longitudinal direction in relation to a main flow direction of a hot gas flowing through the base body, and wherein the plating elements are arranged about the base body in a spiral manner thereby allowing an application of the plating elements to the base material such that stress on the base material is reduced.

11. The gas turbine as claimed in claim 10, wherein an embodiment of a machine component may be selected from the group consisting of a flame tube of a combustion chamber, a combined housing of a combustion chamber and an inner housing of a combustion chamber.

12. The gas turbine as claimed in claim 10, wherein a tilt angle is greater than 0° and less than 90°.

13. The gas turbine as claimed in claim 10, wherein the plating elements are positioned in a segmented configuration.

14. The gas turbine as claimed in claim 10, wherein the plating elements are applied to the base body by welding.

15. The gas turbine as claimed in claim 14, wherein the plating elements are applied to the base body by laser powder hardfacing.

16. The gas turbine as claimed in claim 10, wherein the plating elements are applied to the base body by a spray build up.

17. The gas turbine as claimed in claim 13, wherein the plating elements are introduced to a flat surface of the base body.

18. The machine component as claimed in claim 8, wherein the plating elements are applied to the base body by continuous welding.

19. The gas turbine as claimed in claim 10, wherein each plating element is incorporated into an assigned recess formed in the based body.

* * * * *